United States Patent [19]

Jones

[11] Patent Number: 5,025,816

[45] Date of Patent: Jun. 25, 1991

[54] HAIR ROLLER

[76] Inventor: Lois F. Jones, 222 Arnett Rd., Madison, Ala. 35758

[21] Appl. No.: 457,844

[22] Filed: Dec. 27, 1989

[51] Int. Cl.[5] ..... A45D 2/20

[52] U.S. Cl. ..... 132/247; 132/246; 132/245

[58] Field of Search ..... 132/222, 243, 245, 246, 132/247, 248, 250, 253, 254, 255, 256, 257, 258; 128/157, 161, 166, 847, 888, 889, 894, 402, 403, 380

[56] References Cited

U.S. PATENT DOCUMENTS

| | | | |
|---|---|---|---|
| 1,538,809 | 5/1925 | Henry | 132/247 |
| 2,524,266 | 10/1950 | Licastro | 132/246 |
| 2,557,060 | 6/1951 | Frishberg | 132/247 |
| 2,563,421 | 8/1951 | Roth | 132/250 |
| 4,055,188 | 10/1977 | Pelton | 128/402 |
| 4,310,008 | 1/1982 | Lalli | 132/247 |
| 4,381,025 | 4/1983 | Schooley | 128/402 |

FOREIGN PATENT DOCUMENTS

| | | | |
|---|---|---|---|
| 721082 | 11/1965 | Canada | 132/248 |
| 2194437 | 3/1988 | United Kingdom | 132/222 |

*Primary Examiner*—John J. Wilson
*Assistant Examiner*—Frank A. LaViola
*Attorney, Agent, or Firm*—John C. Garvin, Jr.; Harold W. Hilton

[57] ABSTRACT

A hair roller having a cushioning medium integrally associated therewith for protection of a wearer's scalp. The roller includes an elongated body having a central portion provided with the cushioning medium carried therein. Fasteners are provided on the extending ends of the elongated body which are foldable for secured relation along the central portion of the body to retain the hair in wrapped relation around the central portion.

6 Claims, 1 Drawing Sheet

HAIR ROLLER

FIELD OF THE INVENTION

This invention relates in general to hair rollers and particularly to a hair roller having a soft member or substance carried thereby to protect the wearer's head while being worn thereon.

BACKGROUND OF THE INVENTION

There are many types of devices that are designed to eliminate pressure caused by hair rollers when the rollers are pressed against the scalp as when worn during sleep. One such device is disclosed in U.S. Pat. No. 3,595,247, as a pad having a slit therein through which the hair is inserted prior to being wound on a curler. Such device is bothersome to use since the hair must be threaded through the slit prior to being rolled on a curler and must be removed from the roller prior to being pulled back through the slit. Other types of scalp protecting devices are shown in U.S. Pat. Nos. 3,498,301; and 3,685,524. The protective devices disclosed in these patents also are in the form of separate pads which are used in conjunction with hair rollers. The pads are generally made of a soft, resilient material which are disposed between the rollers and the scalp. These devices are cumbersome and somewhat bothersome to use since they are separate and distinct from the roller and the hair must be rolled around the roller while the pads are held or otherwise manipulated to remain positioned between the roller and the scalp.

It is an object of the present invention, therefore, to provide a hair roller which is simple to use in a hair curling operation and which provides a cushion to protect the scalp of the wearer even while the wearer is laying down.

It is another object of the present invention to provide such a hair roller and cushion as a unitary structure which permits rapid and facile rolling of the hair directly thereon and which also permits rapid and facile unrolling therefrom.

DESCRIPTION OF THE PREFERRED EMBODIMENTS

Figure 1:
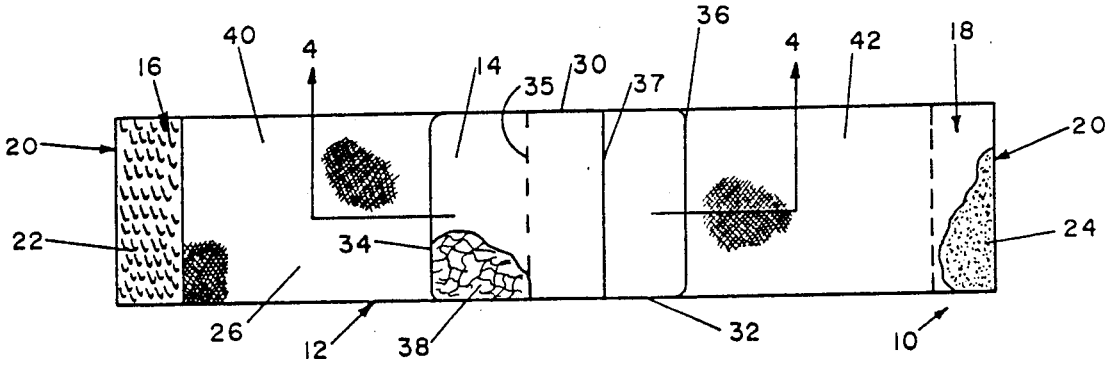
FIG. 1 is an elevational view of the hair roller of the present invention in extended position.

As seen in FIG. 1, the soft hair curler 10 of the present invention includes an elongated body portion 12, which may be made of soft fabric or the like or other suitable soft materials, having a pocket 14 secured thereto or formed as a part thereof. Body portion 12 is shown to have substantially parallel, continuous side edges and is provided at the ends 16 and 18 thereof with a fastener assembly 20 for securing the ends of the curler together. As seen in FIG. 1, fastener assembly 20 is in the form of a Velcro fastener with either one of the two Velcro components 22 and 24 (hooks and piles) being selectively positioned on the (opposing) surfaces 26 and 28 (FIG. 2) respectively of the body portion 12.

The pocket 14 (FIG. 1) may be openable at either of the upper or lower edges 30 and 32 or at either of the side edges 34 and 36 or in overlapping relation substantially along the center as indicated at 35 and 37, for insertion therein of a padding element 38 which may be made of a soft resilient, deformable, flexible material. If desired, padding element 38 may be a capsule filled with air, a gel, liquid (water, etc.), or other soft padding material. Also, if desired, the padding element 38 of either the soft flexible solid material or the liquid may be directly carried in sealed relation in the pocket. For example, if the padding element 38 is a liquid, it may be contained in the capsule and the capsule removably or permanently affixed in the pocket. In similar manner, if the padding element 38 is a fabric or soft rubbery material, it may also be removably or permanently affixed in the pocket. The curler 10 is shown to have a pair of elongated body portions 40 and 42 respectively disposed between ends 16 and 18 and pocket 14.

Figure 2:
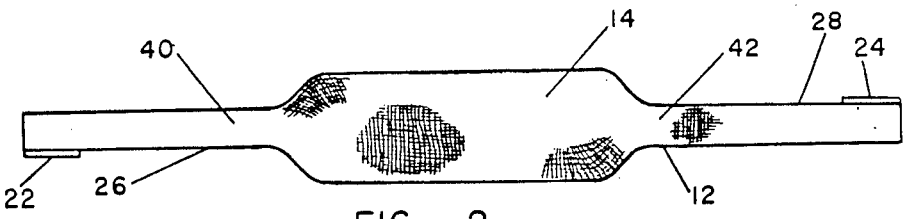
FIG. 2 is a top view of the hair roller of FIG. 1.
Figure 3:
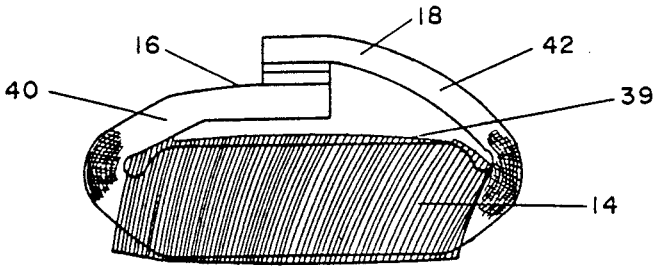
FIG. 3 is a top view of the hair roller of FIG. 1 in folded, operable position.

FIG. 2 is a top view of the curler in extended position and FIG. 3 is a top view of the curler in folded operable position. As seen in FIG. 3, the ends 16 and 18 are in secured relation with the hair 39 of an individual entrapped between the elongated portions 40 and 42 of body 12, and rolled around the encapsulating pocket 14.

Figure 4:
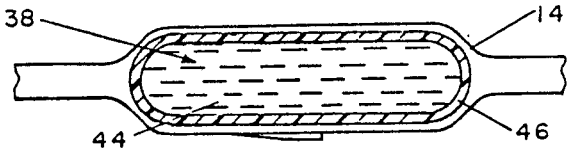
FIG. 4 is a sectional view of the hair roller along line 4—4 of FIG. 1 showing the padding element to be a liquid filled capsule.

FIG. 4 is a sectional view of the pocket area of the curler and illustrates the padding element 38 to be a liquid 44 carried in a capsule 46 which in turn is carried in pocket 14.

Figure 5:
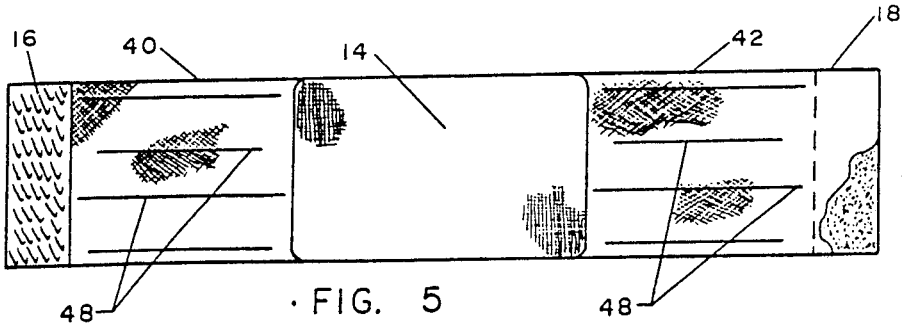
FIG. 5 is a plan view of another embodiment of the present invention.

FIG. 5 illustrates another embodiment of the present invention wherein like numerals refer to like parts. As seen in FIG. 5 elongated body portions 40 and 42 include a plurality of substantially stiff, bendable ribs 48 extending between the pocket 14 and the ends 16 and 18 of the curler. The ribs are for providing rigidity to the curler and may be made of plastic, wire, or other suitable materials. Also, the ribs may be carried on the inner and/or outer opposing surfaces 26 and 28 or imbedded in the material between the surfaces 26 and 28.

It is to be understood that while the pocket has been described as being secured to the body 12, it may also be formed as part of and made integral with the body 12 and the encapsulated material may be permanently affixed or removably carried in the pocket.

It is to be also understood that the liquid or gel filled capsule may be capable of being heated or cooled, if desired.

While the above description constitutes preferred embodiments of the present invention, it will be appreciated that the invention is susceptible to modification, variation and change without departing from the proper scope and fair meaning of the accompanying claims.

I claim:

1. A hair roller disposed for being wound in the hair adjacent the scalp of an individual comprising:

an elongated body having spaced first and second end portions, each end portions having a distal end, said elongated body provided with a non-rigid intermediate portion having a pocket therein and spaced substantially parallel continuous side edges;

a soft padding means insertable in said pocket of said intermediate portion, said padding means being a capsule having a liquid carried therein, said padding means forming a roller like element for receiving said hair of said individual in wrapped around relation, and, fastening means disposed on said distal ends for secured relation therebetween for retention of said hair in said wrapped around relation around said intermediate portion, said fastening means including first and second fastening members, said first fastening member disposed at said distal end of said first end portion, said second fastening member disposed at said distal end of said second end portion.

2. A hair roller as set forth in claim 1 wherein said capsule is removably carried in said pocket.

3. A hair roller disposed for being wound in the hair adjacent the scalp of an individual comprising:

an elongated body having spaced first and second end portions, each end portions having a distal end provided with a fastener member thereon, said elongated body provided with a non-rigid intermediate portion having a pocket therein and spaced substantial parallel continuous side edges, and a plurality of stiffener members carried in said end portions on opposite sides of said intermediate portion;

a soft padding means insertable in said pocket of said intermediate portion, said padding means being a capsule having a liquid carried therein, said padding means forming a roller like element for receiving said hair of said individual in wrapped around relation, and, fastening means disposed on said distal ends for secured relation therebetween for retention of said hair in said wrapped around relation around said intermediate portion, said fastening means including first and second fastening members, said first fastening member disposed at said distal end of said first end portion, said second fastening member disposed at said distal end of said second end portion.

4. A hair roller as set forth in claim 3 wherein said stiffener members are a plurality of substantially stiff, bendable, rod-like elements.

5. A hair roller as set forth in claim 4 wherein said rod-like elements are wire.

6. A hair roller as set forth in claim 3 wherein said capsule is removably carried in said pocket.

* * * * *